US009220325B2

(12) United States Patent
Ma

(10) Patent No.: US 9,220,325 B2
(45) Date of Patent: Dec. 29, 2015

(54) CANTILEVER UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 14/478,275

(22) Filed: Sep. 5, 2014

(65) Prior Publication Data

US 2015/0068566 A1 Mar. 12, 2015

Related U.S. Application Data

(60) Provisional application No. 61/874,925, filed on Sep. 6, 2013.

(51) Int. Cl.

| | |
|---|---|
| ***A45B 17/00*** | (2006.01) |
| ***A45B 23/00*** | (2006.01) |
| *A45B 25/14* | (2006.01) |

(52) U.S. Cl.

CPC ..... *A45B 23/00* (2013.01); *A45B 17/00* (2013.01); *A45B 2023/0012* (2013.01); *A45B 2023/0037* (2013.01); *A45B 2025/146* (2013.01)

(58) Field of Classification Search

CPC ..... A47B 17/00; A47B 17/005; A47B 19/00; A47B 23/00; A47B 25/14; A47B 2023/0012; A47B 2023/0031; A47B 2023/0037; A47B 2023/005; A47B 2023/0075; A47B 2023/0081; A47B 2023/0087

USPC ..... 135/20.1, 20.3, 21

See application file for complete search history.

(56) References Cited

U.S. PATENT DOCUMENTS

| | | | |
|---|---|---|---|
| 2,183,833 | A | 12/1939 | Farhar |
| 2,235,518 | A | 3/1941 | Goshaw |
| 2,475,406 | A | 7/1949 | Russell |
| 2,661,752 | A | 12/1953 | Kampf et al. |
| 2,670,133 | A | 2/1954 | Volker |
| 2,721,569 | A | 10/1955 | Militano |
| 2,724,396 | A | 11/1955 | Pereira |

(Continued)

FOREIGN PATENT DOCUMENTS

| | | | |
|---|---|---|---|
| CN | 2419864 | Y | 2/2001 |
| CN | 2441342 | Y | 8/2001 |

(Continued)

OTHER PUBLICATIONS 6 page machine translations of CN201197439Y printed Feb. 23, 2015.*

(Continued)

*Primary Examiner* — Robert Canfield

(74) *Attorney, Agent, or Firm* — Knobbe Martens Olson & Bear, LLP

(57) ABSTRACT

An umbrella is provided that has a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is pivotally coupled with the second support member. The umbrella also has an enclosure disposed at the first end of the second support member. A canopy control mechanism is disposed in the enclosure to alter the configuration of the canopy.

21 Claims, 8 Drawing Sheets

(56) References Cited

U.S. PATENT DOCUMENTS

| | | | | |
|---|---|---|---|---|
| 2,905,187 | A | 9/1959 | Croce | |
| 2,914,154 | A | 11/1959 | Russell | |
| 3,120,238 | A | 2/1964 | Glatz | |
| 3,129,715 | A | 4/1964 | Fleischer et al. | |
| 3,142,307 | A | 7/1964 | Danciart et al. | |
| 3,145,720 | A | 8/1964 | Torii | |
| 3,150,671 | A | 9/1964 | Frey | |
| 3,175,568 | A | 3/1965 | Kafka | |
| 3,182,673 | A | 5/1965 | Small | |
| 3,486,514 | A | 12/1969 | Prescott | |
| 3,765,434 | A | 10/1973 | Riggs | |
| 3,926,202 | A | 12/1975 | Uthemann et al. | |
| 4,148,164 | A | 4/1979 | Humphrey | |
| 4,582,078 | A | 4/1986 | Ma | |
| 4,586,525 | A | 5/1986 | Glatz et al. | |
| 4,606,366 | A | 8/1986 | Collet | |
| 4,622,987 | A | 11/1986 | Redl et al. | |
| 4,674,523 | A | 6/1987 | Glatz | |
| 4,697,606 | A | 10/1987 | Ma | |
| 4,878,509 | A | 11/1989 | Tung | |
| 5,002,081 | A | 3/1991 | Stromeyers | |
| 5,029,596 | A | 7/1991 | Tung | |
| 5,086,797 | A | 2/1992 | Earnshaw et al. | |
| 5,116,258 | A | 5/1992 | Vennik | |
| 5,156,395 | A | 10/1992 | Smith | |
| 5,161,764 | A | 11/1992 | Roney | |
| 5,349,975 | A | 9/1994 | Valdner | |
| 5,437,297 | A | 8/1995 | Crisman et al. | |
| 5,492,232 | A | 2/1996 | Ohm | |
| 5,499,644 | A | 3/1996 | Geniele | |
| 5,584,564 | A | 12/1996 | Phyle | |
| 5,611,364 | A | 3/1997 | Woods et al. | |
| 5,678,585 | A | 10/1997 | May | |
| 5,711,333 | A | 1/1998 | Vanderminden, Sr. | |
| 5,735,302 | A | 4/1998 | Saliva | |
| 5,785,069 | A | 7/1998 | Glatz | |
| D398,443 | S | 9/1998 | Bolle | |
| 5,845,665 | A | 12/1998 | Koehn | |
| 5,868,152 | A | 2/1999 | Brown | |
| 5,871,024 | A | 2/1999 | Vanderminden, Sr. | |
| 5,937,882 | A | 8/1999 | Harbaugh | |
| 5,960,806 | A | 10/1999 | Steiner | |
| 6,014,980 | A | 1/2000 | Glatz | |
| D434,215 | S | 11/2000 | Lin | |
| 6,152,156 | A | 11/2000 | Tung | |
| D434,556 | S | 12/2000 | Lin | |
| 6,209,147 | B1 | 4/2001 | Wheaton | |
| 6,220,261 | B1 | 4/2001 | Glatz | |
| 6,311,705 | B1 | 11/2001 | Ma | |
| 6,321,763 | B1 * | 11/2001 | Ma | 135/20.1 |
| 6,330,886 | B1 | 12/2001 | Culver | |
| 6,435,444 | B1 | 8/2002 | Lin | |
| 6,446,650 | B1 | 9/2002 | Ma | |
| 6,478,037 | B2 | 11/2002 | Tung | |
| 6,520,192 | B1 | 2/2003 | Lo | |
| 6,571,403 | B2 | 6/2003 | Wheaton | |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| 6,607,002 | B2 | 8/2003 | Reese | |
| 6,619,306 | B2 | 9/2003 | Ma | |
| 6,662,815 | B2 | 12/2003 | Tung | |
| 6,761,180 | B1 | 7/2004 | Lai | |
| D497,479 | S | 10/2004 | Yu | |
| 6,827,094 | B1 | 12/2004 | Bramwells | |
| 6,837,255 | B2 | 1/2005 | Bunch et al. | |
| 6,840,253 | B2 | 1/2005 | Ma | |
| 6,851,823 | B2 | 2/2005 | Bilotti | |
| 6,923,193 | B2 | 8/2005 | Chen | |
| 6,926,019 | B2 | 8/2005 | Glatz | |
| 6,945,263 | B2 | 9/2005 | Li | |
| 6,953,043 | B2 | 10/2005 | Yu | |
| 6,988,504 | B1 | 1/2006 | Goldwitz | |
| D518,629 | S | 4/2006 | Ma | |
| 7,108,388 | B2 | 9/2006 | Li | |
| 7,134,442 | B2 | 11/2006 | Ma | |
| 7,207,343 | B2 | 4/2007 | Earnshaw et al. | |
| 7,255,118 | B2 | 8/2007 | Vardy et al. | |
| 7,341,068 | B2 | 3/2008 | Liu | |
| 7,398,790 | B2 | 7/2008 | Glatz | |
| 7,412,985 | B2 | 8/2008 | Ma | |
| 7,493,909 | B2 | 2/2009 | Ma | |
| 7,520,289 | B1 | 4/2009 | Barber | |
| 7,533,680 | B2 | 5/2009 | Ma | |
| 7,556,051 | B2 | 7/2009 | Lai | |
| 7,708,022 | B2 | 5/2010 | Joen-an Ma | |
| 7,717,121 | B2 | 5/2010 | Glatz | |
| D621,600 | S | 8/2010 | He | |
| 7,866,331 | B2 | 1/2011 | Glatz | |
| 7,886,755 | B2 | 2/2011 | Tung | |
| 7,913,707 | B2 | 3/2011 | Lai | |
| 7,918,054 | B2 | 4/2011 | Grafton | |
| D638,622 | S | 5/2011 | He | |
| 7,980,261 | B2 | 7/2011 | Glatz | |
| 8,066,021 | B2 | 11/2011 | Ma | |
| 8,104,492 | B2 | 1/2012 | Dan | |
| 8,113,223 | B2 | 2/2012 | Wang et al. | |
| 8,360,080 | B2 | 1/2013 | Liu et al. | |
| 8,522,804 | B1 | 9/2013 | Tung | |
| 2002/0083969 | A1 | 7/2002 | Tung | |
| 2002/0104557 | A1 | 8/2002 | Tung | |
| 2002/0129847 | A1 | 9/2002 | Ma | |
| 2002/0174887 | A1 | 11/2002 | Reese | |
| 2003/0010366 | A1 | 1/2003 | Glatz | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0177871 | A1 * | 9/2004 | Harbaugh | 135/20.1 |
| 2004/0182429 | A1 | 9/2004 | Chen | |
| 2004/0261827 | A1 * | 12/2004 | Chen | 135/20.1 |
| 2005/0013130 | A1 | 1/2005 | Li | |
| 2005/0016571 | A1 | 1/2005 | Wu | |
| 2005/0028852 | A1 | 2/2005 | Reese | |
| 2005/0041425 | A1 | 2/2005 | Li | |
| 2005/0183762 | A1 | 8/2005 | Ma | |
| 2005/0229957 | A1 | 10/2005 | Glatz | |
| 2005/0268952 | A1 * | 12/2005 | Joen-an Ma | 135/20.1 |
| 2005/0268953 | A1 | 12/2005 | Ma | |
| 2006/0081277 | A1 | 4/2006 | Liu | |
| 2006/0169307 | A1 | 8/2006 | Lo | |
| 2006/0201542 | A1 * | 9/2006 | Ma | 135/20.3 |
| 2006/0243311 | A1 | 11/2006 | Glatz | |
| 2006/0278262 | A1 | 12/2006 | Ma | |
| 2007/0074751 | A1 * | 4/2007 | Fraser | 135/98 |
| 2007/0163632 | A1 * | 7/2007 | Chang | 135/21 |
| 2007/0209688 | A1 | 9/2007 | Earnshaw | |
| 2010/0051074 | A1 * | 3/2010 | Dan | 135/20.3 |
| 2010/0101614 | A1 | 4/2010 | Wang et al. | |
| 2010/0192997 | A1 | 8/2010 | Liu et al. | |
| 2010/0212705 | A1 | 8/2010 | Tung | |
| 2011/0005558 | A1 | 1/2011 | Lai | |
| 2013/0092200 | A1 | 4/2013 | May | |
| 2013/0333734 | A1 * | 12/2013 | Ma | 135/20.1 |
| 2014/0158173 | A1 * | 6/2014 | Li et al. | 135/20.1 |
| 2014/0166060 | A1 | 6/2014 | Ma | |
| 2014/0230867 | A1 | 8/2014 | Ma | |
| 2014/0311537 | A1 * | 10/2014 | Ma | 135/20.1 |
| 2015/0059815 | A1 | 3/2015 | Xiong | |

FOREIGN PATENT DOCUMENTS

| | | | |
|---|---|---|---|
| CN | 2621472 | Y | 6/2004 |
| CN | 2843147 | Y | 12/2006 |
| CN | 2896981 | | 5/2007 |
| CN | 201001460 | Y | 1/2008 |
| CN | 201001463 | Y | 1/2008 |
| CN | 201076109 | Y | 6/2008 |
| CN | 201135192 | Y | 10/2008 |
| CN | 201197439 | Y | 2/2009 |
| CN | 201207982 | Y | 3/2009 |
| DE | 580503 | | 7/1933 |

(56) References Cited

FOREIGN PATENT DOCUMENTS

| | | | |
|---|---|---|---|
| DE | 2259192 | | 6/1974 |
| DE | 3229776 | | 4/1983 |
| DE | 3820573 | | 8/1989 |
| DE | 297 12 024 | | 9/1997 |
| DE | 299 06 116 | | 8/1999 |
| DE | 20205561 | | 7/2002 |
| DE | 10 2008 034 985 | | 2/2010 |
| EP | 0 392 989 | | 10/1990 |
| EP | 1 400 186 | | 3/2004 |
| EP | 1700536 | A1 * | 9/2006 |
| EP | 2 103 230 | | 9/2009 |
| EP | 2 425 738 | | 3/2012 |
| GB | 22218 | | 9/1911 |
| WO | WO 97/04682 | | 2/1997 |
| WO | WO 00/55456 | | 9/2000 |
| WO | WO 2005/018369 | | 7/2004 |

OTHER PUBLICATIONS

Extended European Search Report issued in European Patent Application No. 14183987.8, dated Oct. 15, 2014, in 6 pages.

Extended European Search Report issued in European Patent Application No. 14183979.5, dated Oct. 16, 2014, in 6 pages.

Extended European Search Report issued in European Patent Application No. 14185661.7, dated Feb. 4, 2015, in 8 pages.

Activa Leisure, 2010 Product Catalog.

Treasure Garden, 2010 Product Catalog.

Operation Manual Easy Sun Parasol Sunshade (Issue: Jul. 2004) pp. 1-17.

Extended European Search Report issued in European Patent Application No. 14155827.0, dated Apr. 29, 2014, in 6 pages.

* cited by examiner

CANTILEVER UMBRELLA

BACKGROUND OF THE INVENTION

1. Field of the Invention

The disclosure relates to the field of shade structures, particularly umbrella and parasol devices and more particularly to an umbrella or parasol with a tilt feature.

2. Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly that comprises a fabric-like material mounted over a plurality of support ribs. The support ribs can be collapsed into a storage position for the canopy assembly and can be deployed and supported in position to hold up and extend the fabric and thereby provides protection from the elements. The canopy assembly is generally supported from beneath or from above. Umbrellas supported from above have the advantage of providing space below the canopy where people can sit without the obstruction of a pole extending from below the canopy to the ground.

U.S. Pat. No. 6,840,253 discloses an umbrella supported from above, which includes a side post and side arm for supporting a canopy. The side arm, and thereby the canopy, can be rotated between specific positions by means of a drive bar that can be manipulated to both rotate the side arm and latch it in one of the positions. Thus, while this design provides some ability to tilt the canopy by rotation of its suspending side arm, that rotation can only be achieved between fixed latch positions and is therefore of limited convenience.

U.S. Pat. Nos. 6,152,156 and 6,478,037 to Tung disclose another variation of a sunshade with tiltable canopy, wherein a canopy assembly is suspended from above by an arcuate tube that is hingedly connected to a generally vertically extending support pole. Thus, by adjustment of the hinged interconnection between the arcuate tube and the vertical support pole, the canopy assembly of the Tung '156 and '037 devices can be tilted inwards and outwards from a generally vertically extending orientation. However, this construction appears to only offer a tilt in a single direction away from the generally vertical support pole.

Finally, U.S. Pat. No. 6,588,438 discusses a free-arm shade that has a radial shade ribs, support ribs attached to the shade ribs, and a shade rod slide that is freely attached to support ribs. It also has a decentral pole standing outside the shade. One of the shade ribs is vertically displaceably attached to pole by its outer end, and functions as a side arm. On its top side, the shade rib/side arm is connected to pole tip via an articulated rib. The shade rib/side arm has a pivot joint between the edge of the shade fabric and the pole. Articulated rib is connected to shade rib/side arm via a pivot hinge. Shade rib/side arm can be pivoted around the axis between pivot joint and pivot hinge. Although this structure enables the tilting of the shade sideways in relation to pole, there is no clear provision for separate operation of the canopy, such as for opening and closing the shade.

SUMMARY OF THE INVENTION

There is a need for new cantilever umbrellas include more flexible operation of a canopy thereof. It would be an advance in the art to provide canopy operation mechanisms that change multiple aspects or configurations of the umbrella.

This application is directed to a cantilever umbrella having canopy controls mounted between a slide or runner and the canopy. In some cases, the mounting of the canopy controls shortens and/or straightens the path of a tension member to reduce the complexity and/or failure modes of the umbrella.

In one embodiment, an umbrella assembly is provided that includes a support pole, a canopy, a strut, and a canopy adjustment module. The support pole has a lower end and an upper end. The canopy assembly has an upper hub having a plurality of canopy fabric support ribs and a boom extending radially therefrom. The boom is disposed between two adjacent canopy fabric support ribs and has a first end coupled with the hub and a second end disposed adjacent to the support pole. The strut is pivotally coupled with the support pole at an upper end and with the boom at a lower end. The canopy adjustment module disposed between the boom and the support pole. The canopy adjustment module has a housing, a shade angle mechanism, and an opening and closing mechanism. The shade angle mechanism is disposed at least partially within the housing. The shade angle mechanism is configured to rotate boom about an axis of the boom. Such rotation displaced an opening of the canopy from horizontal by an angle. The opening and closing mechanism is at least partially disposed within the housing and operable by a crank.

In another embodiment, a cantilever umbrella is provided that has a support pole, a boom, and a canopy assembly. The support pole has a lower end and an upper end. The boom is coupled with the support pole at an inner end. The boom has an outer end disposed away from the support pole. The canopy assembly is coupled with the boom. The cantilever umbrella also has a housing disposed at the inner end of the boom. The housing has a worm gear pair disposed therein for adjusting the shade angle of the canopy. The housing also has a spool and tension member disposed therein for opening and closing the canopy.

An umbrella is provided that has a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is pivotally coupled with the second support member. A canopy control mechanism is disposed in the enclosure to alter the configuration of the canopy.

In some cases, the canopy control mechanism includes a tilt mechanism disposed in an enclosure to alter the angle of the canopy.

In some cases, the canopy control mechanism a canopy deployment mechanism disposed in an enclosure to open and close the canopy.

The enclosure can be disposed at the first end of the second support member. The enclosure can include a separable member. In some cases, the enclosure comprises a housing that may be separated to facilitate mounting the control mechanism therein.

In some cases, indicia of the umbrella configuration are provided at the first end of the second support member. For example, a pointer can be mounted on one or both of the second support member and the enclosure. The pointer can point to a scale disposed on the second support member, the enclosure, or both the second support member and the enclosure.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
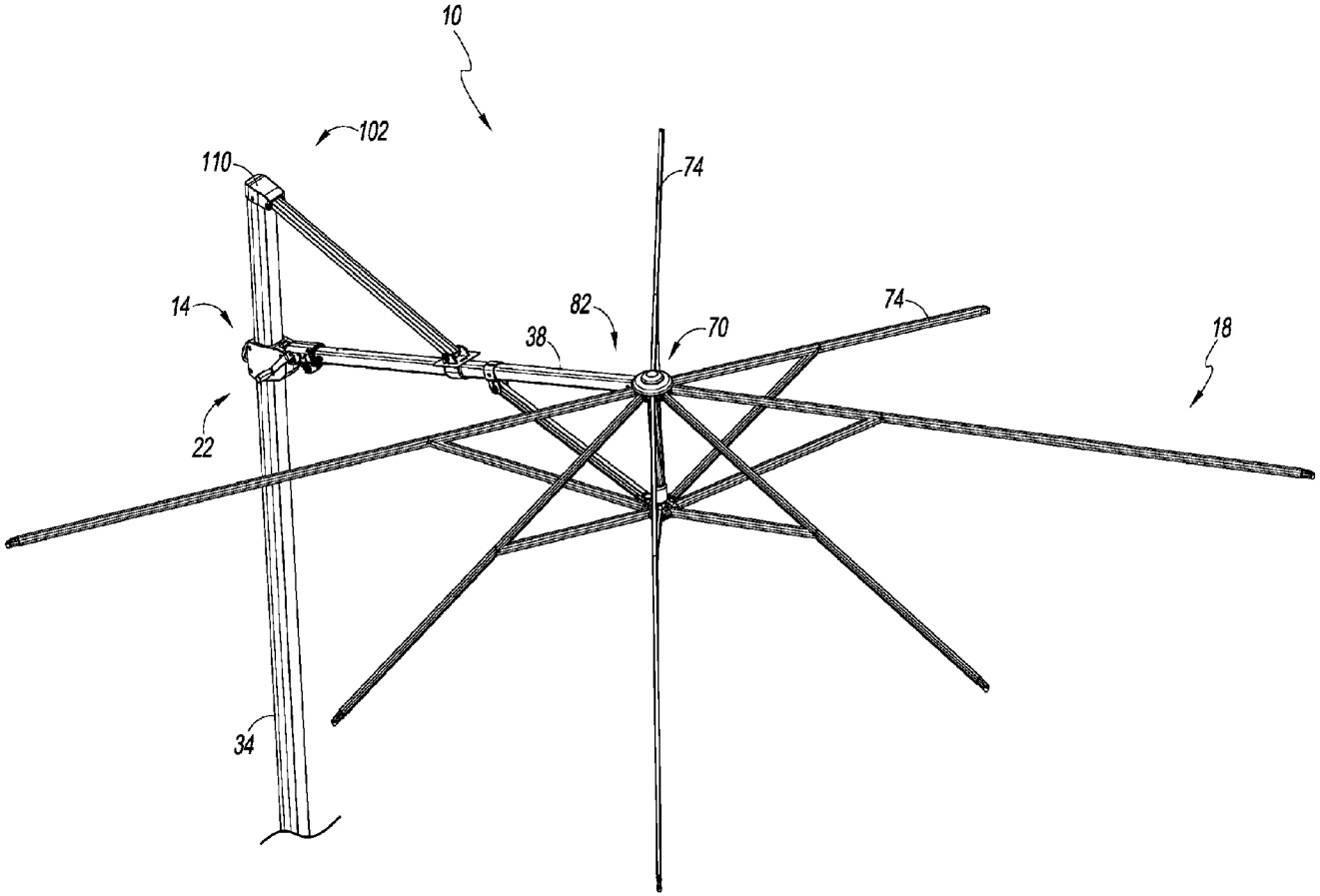
FIG. 1 is a perspective view of an umbrella frame and pole assembly for an umbrella.
Figure 2:
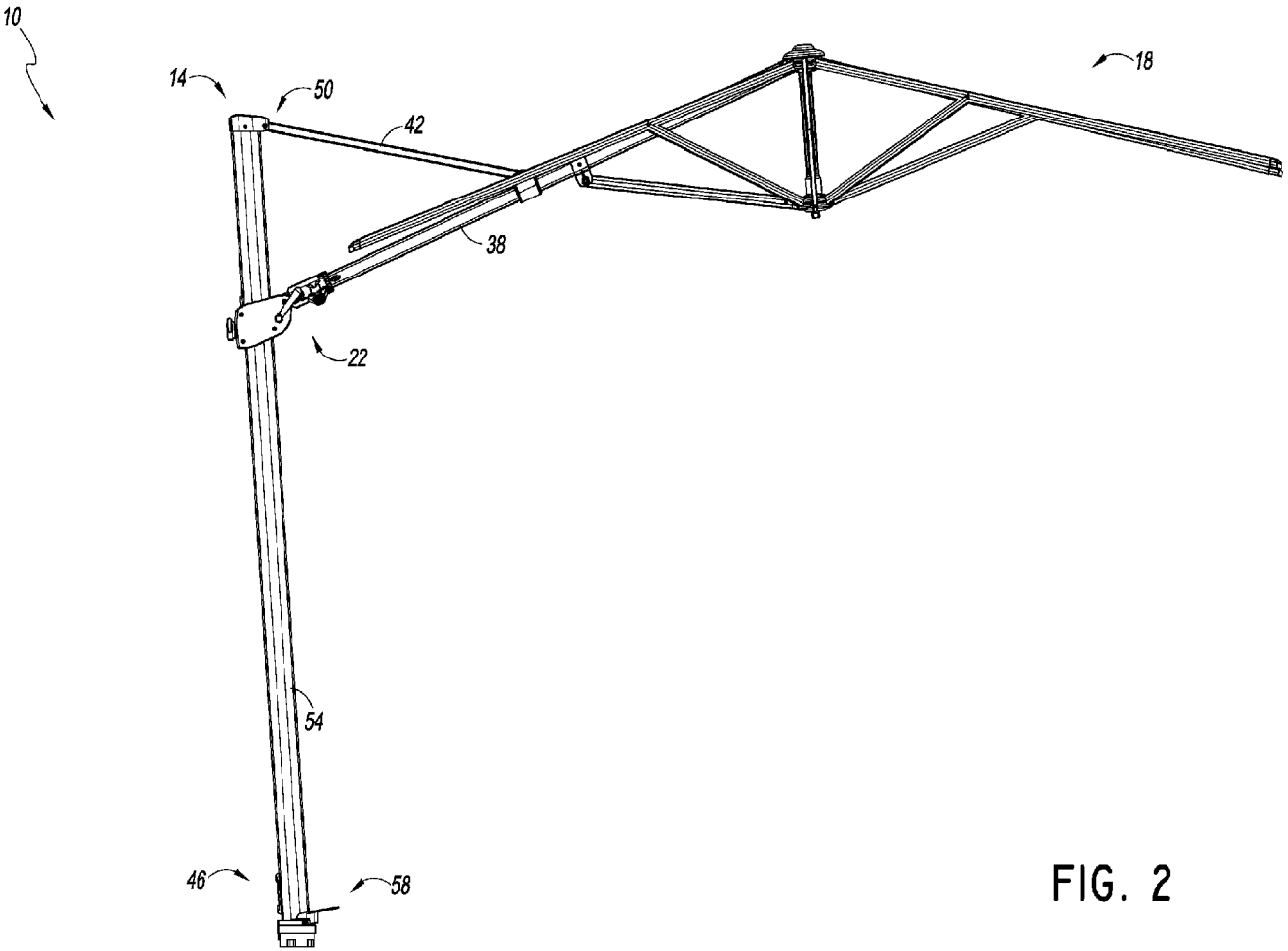
FIG. 2 is a side view of the umbrella of FIG. 1.
Figure 3:
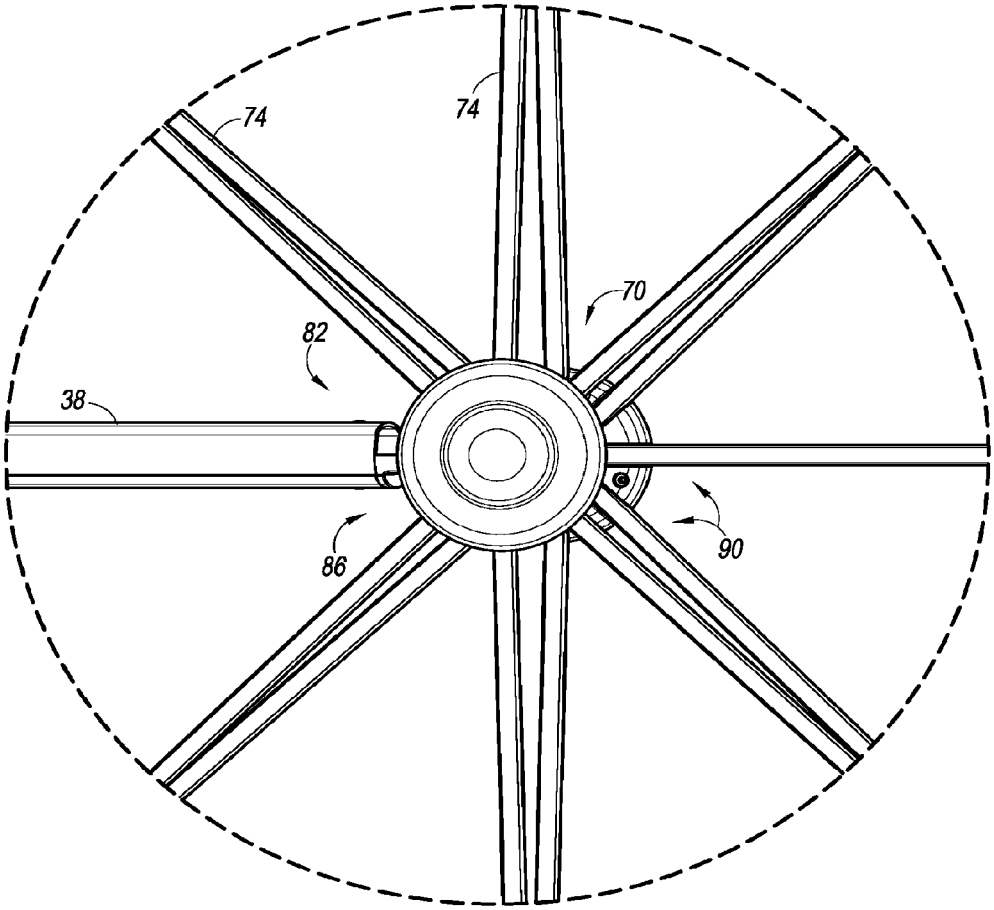
FIG. 3 is a top view of an upper portion of a canopy assembly of the umbrella of FIG. 1.

FIG. 1 illustrates one embodiment of an umbrella 10 that can be positioned in a variety of useful positions to provide shelter. The umbrella 10 includes a plurality of mechanisms to move a sheltering member, e.g., a canopy assembly or a canopy fabric, between the plurality of useful positions and also to open and close the canopy as much or as little as needed.

The umbrella 10 is provided that includes a support structure 14, a canopy 18, and a control module 22.

The support structure 14 can take a variety of forms. In one embodiment, the support structure 14 includes a support pole 34, a boom 38, and a strut 42 coupled with the support pole and the boom. The support pole 34 has a lower end 46, an upper end 50 and an elongate body 54 extending therebetween. The pole can be configured to be mounted in a fixed position to the ground at or adjacent to the lower end 46. In some embodiments, it is desirable to permit the umbrella 10 to be moved. For example, a pivot device 58 can be provided at or adjacent to the lower end 46 to enable the pole 34 and the boom to rotate about a longitudinal axis of the pole 34. This permits up to 360 degree positioning of the pole 34. An example of a pivot device 58 is disclosed in U.S. Pat. No. 6,488,254 which is incorporated by reference herein in its entirety and enclosed in the appendix.

It may be desirable to move the umbrella 10 to different locations instead of or in addition to pivoting about a longitudinal axis of the longitudinal axis of the pole 34. For such applications, the lower end can be coupled with a moveable base, such as is described in US Patent Publication No. 2012/0025050, in US Patent Publication No. 2012/0024329, or in US Patent Publication No. 2012/0024330. The moveable bases of US Patent Publication No. 2012/0025050, in US Patent Publication No. 2012/0024329, or in US Patent Publication No. 2012/0024330 are hereby incorporated by reference herein in their entireties.

In one embodiment, the canopy assembly 18 has an upper hub 70 having a plurality of ribs 74 extending radially therefrom. The ribs 74 provide support to a canopy fabric (not shown) and stretch the fabric to keep it taught. The boom 38 also extends radially from the upper hub 70 in some embodiments. The boom 38 can be similar in construction at least at a first end 78 of the ribs 74. The boom 38 can have a first end 82 disposed between two adjacent ribs 74 at a boom mounting location 86 of the upper hub 70. The boom mounting location 86 can have the same configuration as each of a plurality of rib mounting locations 90 of the upper hub. In one embodiment, the upper hub 70 is completely symmetrical and the rib and boom mounting locations 90, 86 are identical. This arrangement makes assembly easier in that any orientation of the upper hub 70 is acceptable. A second end 98 of the boom 38 is disposed adjacent to the support pole 34, as discussed further below.

The boom 38 has additional functions when compared with the ribs 74 and may be differ from the ribs 74 at the first end 82. For example, the ribs 74 will generally have first ends coupled with the hub 70 and second ends spaced away from the hubs and not connected to other parts of the support structure 14. In contrast, the boom 38 may be coupled with the support pole 34 at the second end 98. As discussed below in more detail, the boom 38 may be configured to facilitate rotation of the canopy 18 and in maintaining the canopy at an angle other than horizontal.

The strut 42 preferably is pivotally coupled with the support pole 34 at an upper end 102 and with the boom 38 at a lower end 106. In one embodiment, the upper end 102 of the strut 42 is coupled with a cap 110 disposed at the upper end 50 of the support pole 34. The cap 110 is a bracket in one embodiment that can receive one or more pins that can also be coupled with the upper end 102 of the struts. The cap 110 may also have a decorative aspect, but generally is configured to be strong enough to support the boom 38 from above and to carry wind and other external loads to the upper end 102 of the pole 34.

Figure 7:
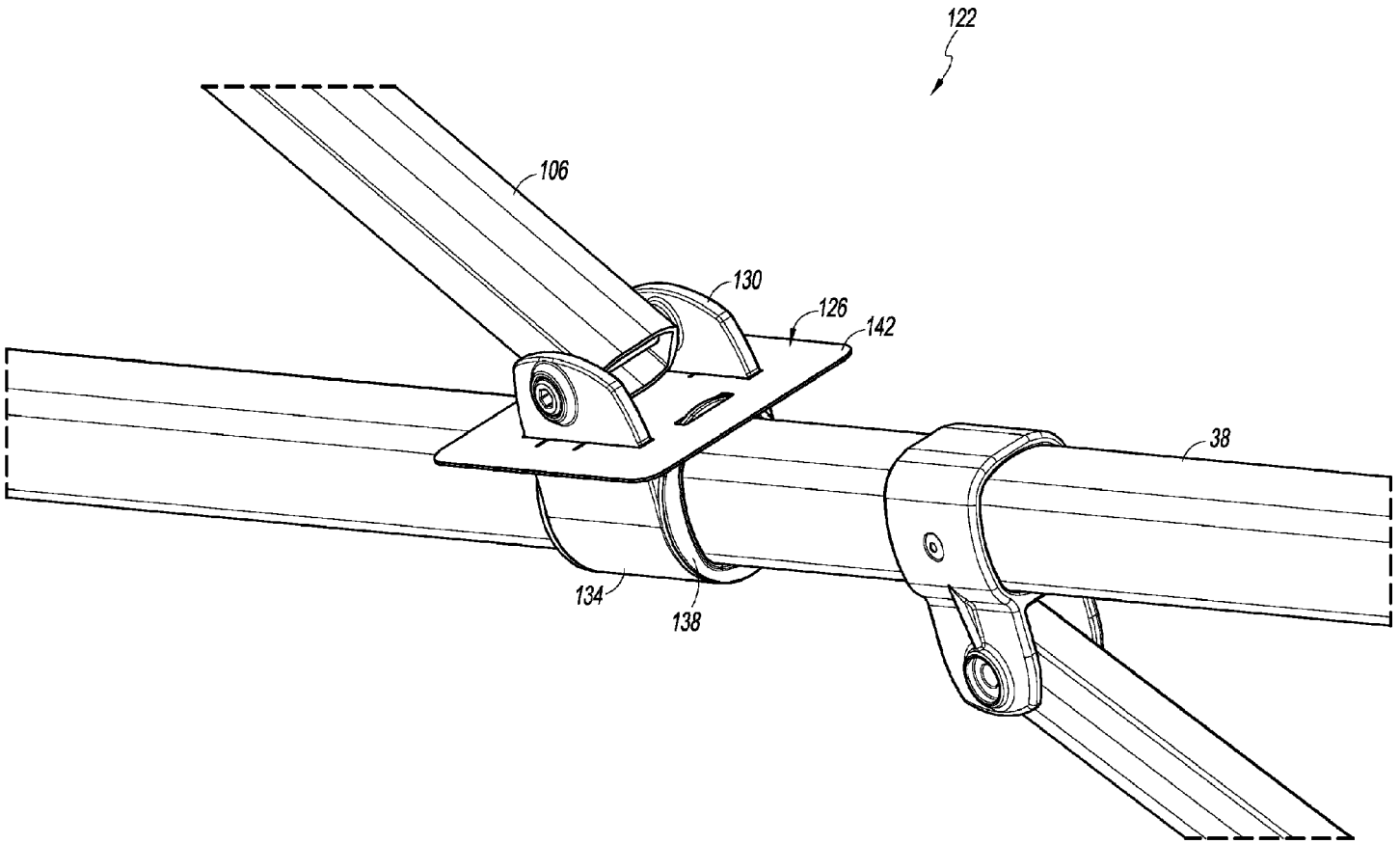
FIG. 7 is a perspective view of a pivot connection between a strut and the boom.
Figure 8:
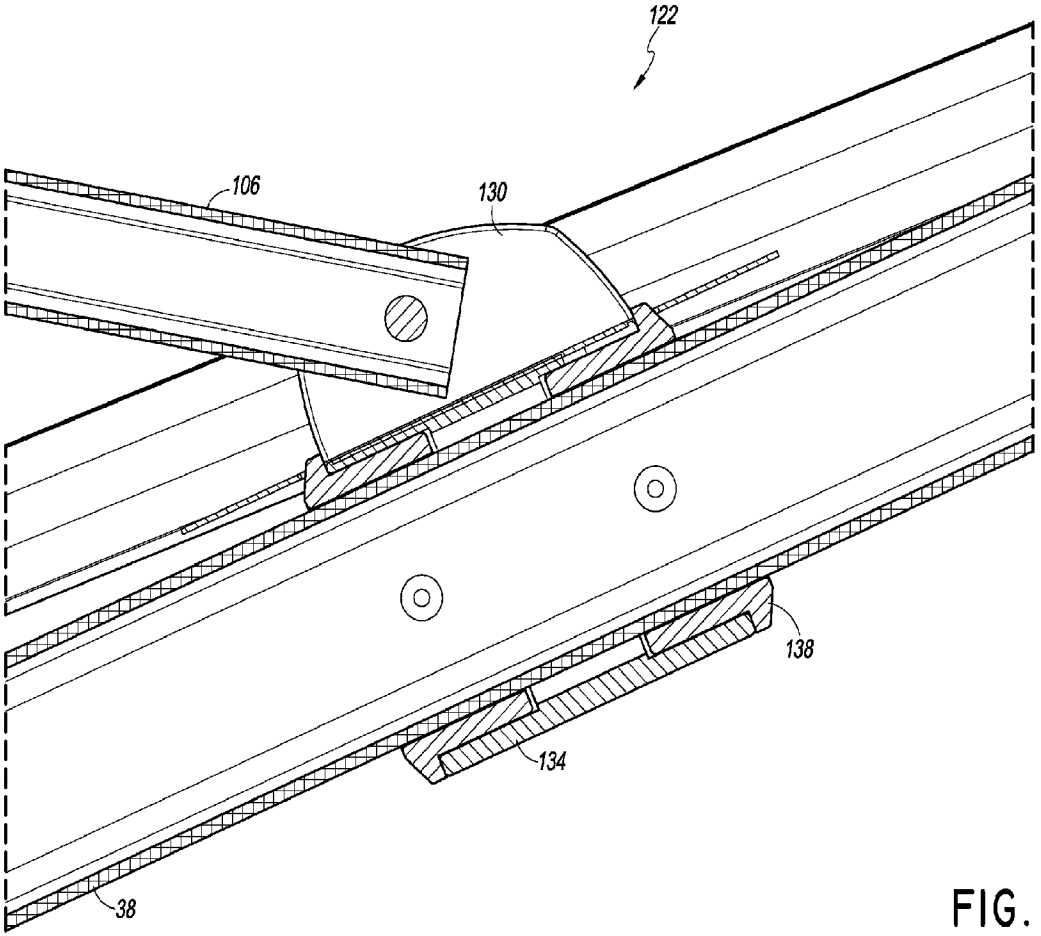
FIG. 8 is a cross-sectional view of the pivot connection illustrated in FIG. 7.

FIGS. 7 and 8 shows more detail of a pivot connection 122 between the lower end 106 of the strut 42 and the boom 38. The pivot connection includes a bracket 126 with upright flanges 130 to which a pin is mounted. The bracket 126 also includes a bearing mount 134 which supports a bearing 138 that facilitates pivoting of the boom 38 about a longitudinal axis of the boom. The inner surface of the bearing mount 134 preferably is circular in cross-section. The bearing 138 preferably has a circular outer surface. The circular surfaces of the bearing mount 134 and the bearing 138 make for smooth sliding of the bearing within the bearing mount during pivoting of the umbrella, discussed more below. The bearing 138 and the bearing mount 134 can be any suitable combination of materials and structure that reduce friction to make operation of the umbrella easier. In one embedment, the bearing is directed connected to the boom 38 by one or more rivet. In one embodiment the outer surface of the boom 38 and the inner surface of the bearing 138 have a non-circular profile, e.g., generally square with rounded corners. The pivot connection 122 may include a transverse flange 142 to which the upright flanges 130 are connected.

The control module 22 preferably is configured to make an adjustment to the canopy 18, and thus is sometimes referred to herein as a canopy adjustment module. The control module 22 preferably is disposed between the upper hub 70 and the support pole 34. In general, the control module 22 is affixed to or is disposed on the boom 38. In other words, the control module is mounted in the umbrella 10 such that it moves with the boom 38 but may be at a variety of positions relative to the support pole 34 depending on the operational condition of the umbrella. Generally the orientation of the control module 22 relative to the boom 38 will not change. This provides a significant advantage in that the components of the control module 22 can be simplified or made more robust by virtue of having to traverse a lower or no range of angles relative to the boom 38.

Figure 4:
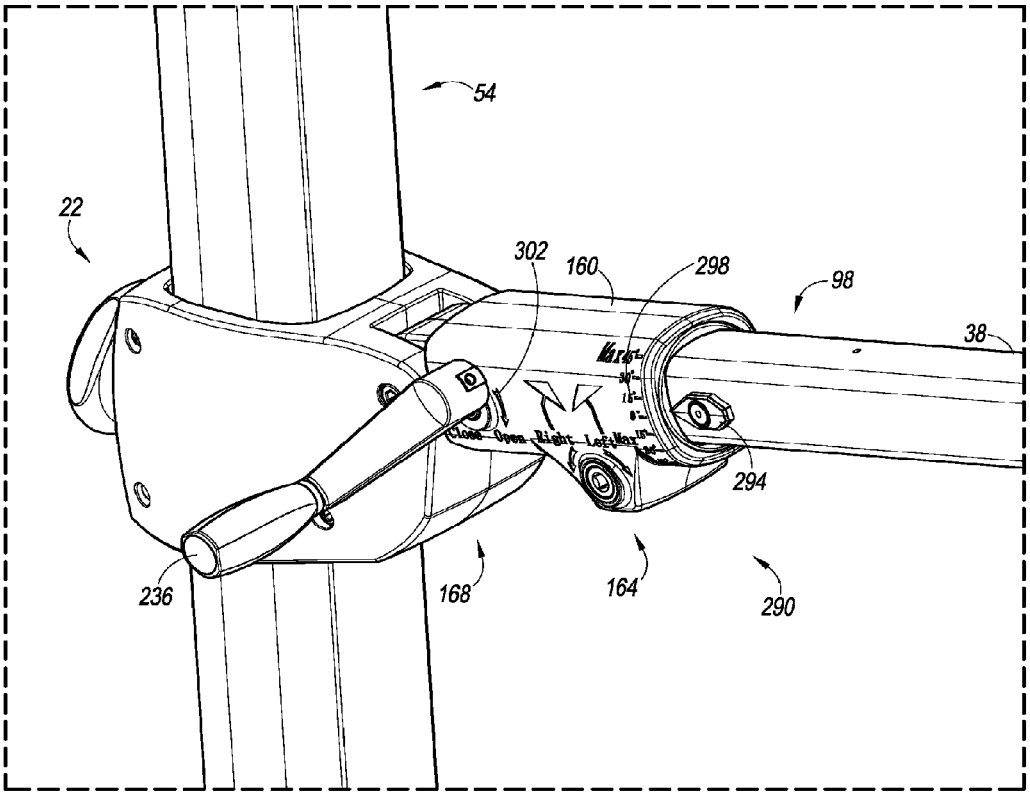
FIG. 4 is a close-up view of a runner or slide of the umbrella of FIG. 1, the slide being pivotally coupled with an umbrella control module.
Figure 5:
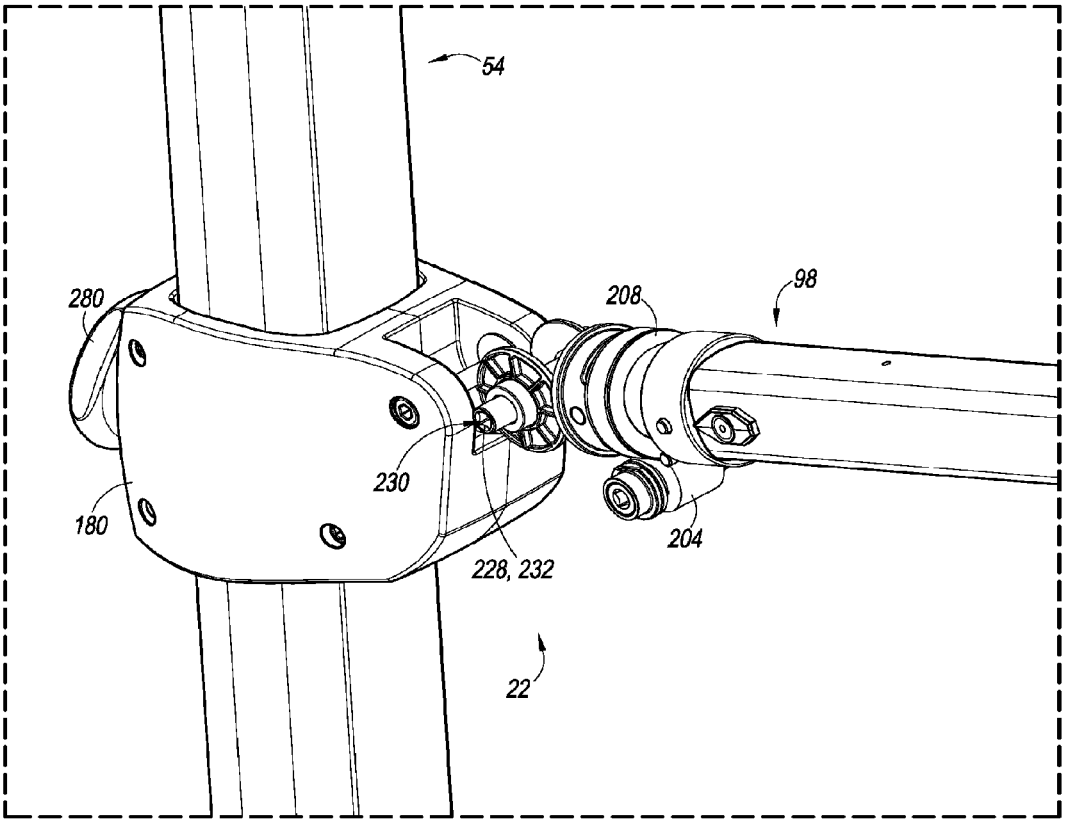
FIG. 5 is a view similar to that of FIG. 4, with a housing portion removed showing internal components.
Figure 6:
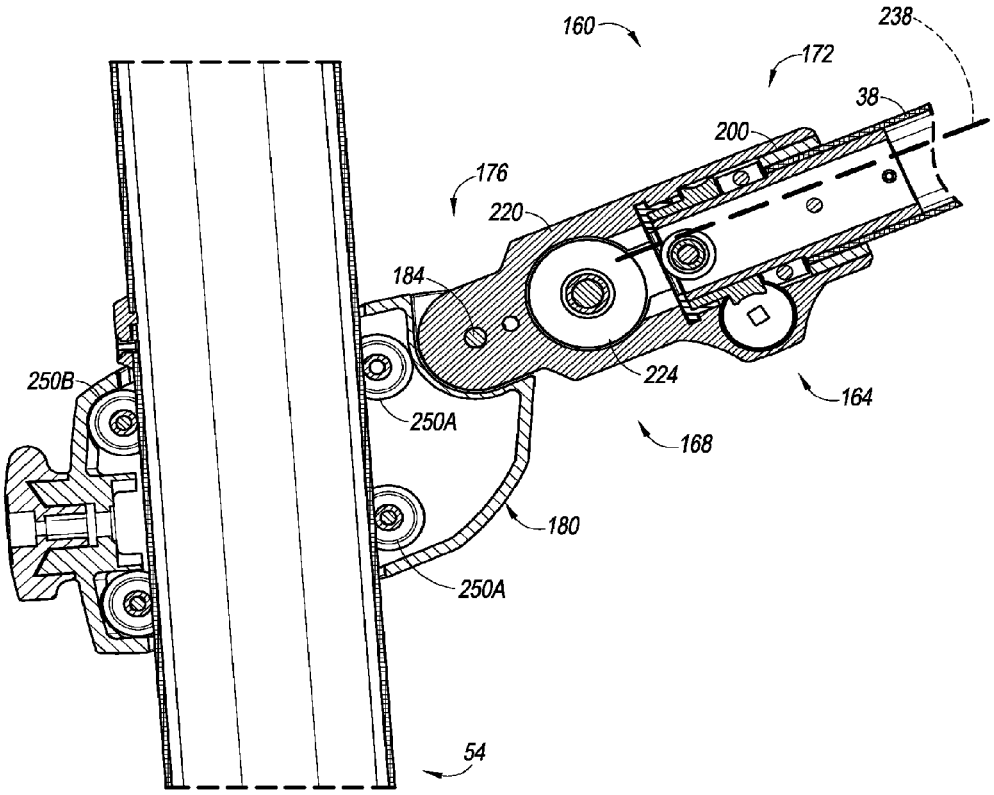
FIG. 6 is a cross-sectional view of the structures illustrated in FIG. 4, the cross-section being taken though a vertical plane including the longitudinal axes of a support pole and the boom.

With reference to FIGS. 4-6, the control module 22 can include a housing 160, a shade angle mechanism 164, and an opening and closing mechanism 168. The housing 160 can take any suitable form, but preferably has a first end 172 to be affixed to or to extend from the boom 38. In some embodiments, a second end 176 of the housing 160 is pivotally coupled with a slide 180. The slide 180 is a traveler that is configured to be moved by the user upward and downward on the support pole 34 along a range of positions, as discussed further below. Pivotal connection between the second end 176 of the housing 160 and the slide 180 is optional, e.g., if the boom 38 has just one position relative to the support pole 34, e.g., a fully extended position. Pivoting of the second end 176 of the housing relative to the slide 180 can be by any suitable structure, such as a simple pin 184 disposed transverse to the plane of movement through the second end and the slide.

FIG. 6 shows that the housing 160 can have a concave structure or recess 200 at the first end 172. The recess is sized to receive the second end 98 of the boom 38. The recess 200 is larger than the second end 98 by enough to provide clearance for the second end 98 to rotate within the recess without obstruction from the housing.

FIGS. 4-6 show that the shade angle mechanism 164 preferably is at least partially disposed in the housing 160. In one embodiment, the shade angle mechanism 164 includes a worm gear 204 disposed in the housing 160 along a rotation axis transverse to the rotational axis of the boom. A ring gear 208 coupled with the boom 38 engages the worm gear 204 such that torque is transmitted from the worm gear 204 to the ring gear 208. Bearings are provided on one or both sides of the ring gear 208 to keep the second end 98 of the boom 38 centered and moving smoothly in the recess 200. The shade angle mechanism 164 is configured to rotate the boom 38 about an axis of the boom. Such rotation displaces an opening 218 of the canopy 18 from horizontal by an angle.

FIGS. 4-6 also show that the opening and closing mechanism 168 can be disposed in the housing 160 in various advantageous embodiments. For example, the housing 160 can include a space 220 disposed therein in which a spool 224 can be journaled for rotation. The spool can be mounted on a shaft 228 that extends to an opening 232 in the housing 160. The shaft 228 can have an engagement feature 230 for coupling with a crank 236. In one embodiment, the crank 236 has a hand crank portion and an engagement feature coupling portion. The engagement feature coupling portion can have a square or other non-round profile to match a corresponding profile of the engagement feature. In one embodiment, the worm gear 204 and the spool each have the same profile so that the same crank can be used for both of the shade angle mechanism 164 and the opening and closing mechanism 168.

A tension member 238 can extend from the spool, e.g., having a first end coupled with the spool 224, a second end coupled with the canopy 18, and an intermediate portion disposed between the first and second ends of the tension member. In some cases, the tension member may be made of a material that is subject to wear. The embodiments discussed herein are extremely advantageous in such cases in that the tension member will not be required to traverse any angles between the support pole 34 and the boom 38. Moreover, the tension member will not have to traverse a boundary between the slide 180 and the boom 38 because the tension member does not extend to the slide. This is particularly advantageous in that the angle between the boom 38 and the slide 180 varies by a great deal from the upper to the lower extents of the range of motion of the slide.

FIG. 6 shows that the movement of the slide 180 between upper and lower positions can be facilitated by rollers 250A, 250B disposed between the support pole 34 and the slide. The rollers 250A, 250B can be mounted to roll along a track formed on an outside surface of the pole. In some embodiments, the rollers 250A, 250B act on opposing surfaces of the pole 34, e.g., with one or a plurality of rollers 250A on a side of the pole from which the boom 38 extends and one or a plurality of rollers 250B on a side of the pole opposite from where the boom extends. In the illustrated embodiment, two rollers 250A are disposed on the side of the pole from which the boom 38 extends and two rollers 250B are disposed on a side of the pole opposite from where the boom extends.

A brake 280 preferably is provided on the slide 180 to allow the user to pick the height of the slide 180 along the support pole 34. The brake 280 thus enables the user to set the angle of the opening 218 of the canopy 18 from horizontal. The angle adjusted by movement of the slide 180 is either toward or away from the support pole 34. The brake 280 can take any suitable form, for example it can be a clamp causing compression of the housing 160 onto the support pole 34. The brake 280 can include a handle for advancing a friction plate against a surface of the support pole 34. The brake 280 can be configured as a pin and detent arrangement. In other embodiments, the brake 280 can include a pawl and rachet arrangement and/or a cam clamp. All of these and other elevation securing means are contemplated to be among the various embodiments herein.

As noted above, one of the aspects of the umbrella to be controlled by the control module 22 is the angle of tilt of the opening 218 of the canopy 18 relative to a plane intersecting the support pole 34 and the center of the boom 38. If one views the umbrella along this plane with the support pole 34 between the point-of-view and the canopy 18 the tilting will be to the left and to the right of this plane. It is advantageous in various embodiments to provide a tile angle indicator 290 to indicate to the user how much tilt is provided. This is useful at least in that the user is generally not able to view the umbrella from the point-of-view just described while operating the shade angle mechanism 164. In one embodiment, the tilt angle indicator 290 comprises a pointer 294 mounted on the boom 38. The pointer 294 can be disposed adjacent to the housing 160. In some embodiments, it is useful to provide visual indicia of the degree of tilt. For example, visual indicia 298 can be provided on the housing 160 adjacent to the pointer 294. As the boom 38 rotates, the pointer 294 moves along the indicia 298 giving an indication of tilt angle, e.g., the shade angle of the umbrella 10.

In some embodiments, the housing 160 includes indicia 302 of directions of greater and lesser open and close. The indicia 302 and the indicia 298 comprise control indicia indicating a plurality of forms of adjustment of the umbrella 10.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella assembly comprising:

a support pole having a lower end and an upper end;

a canopy assembly comprising an upper hub having a plurality of canopy fabric support ribs and a boom extending radially therefrom, the boom being disposed between two adjacent canopy fabric support ribs and having a first end coupled with the hub and a second end disposed adjacent to the support pole;

a strut pivotally coupled with the support pole at an upper end and with the boom at a lower end;

a canopy adjustment module disposed between the boom and the support pole, the canopy adjustment module being pivotable at a pivot axis and comprising:

a housing;

a shade angle mechanism disposed at least partially within the housing and configured to rotate the boom about an axis thereof to displace an opening of the canopy from horizontal by an angle; and an opening and closing mechanism at least partially disposed within the housing and having a spool that is operable by a crank and that rotates about a spool axis, the spool axis spaced apart from the pivot axis.

2. The umbrella assembly of claim 1, wherein the shade angle adjustment mechanism includes a ring gear disposed on an outer surface of the boom and a worm gear disposed in the housing.

3. The umbrella assembly of claim 1, wherein the opening and closing mechanism further comprises a tension member, the tension member having a first end coupled with the spool and a second end coupled with a lower hub of the canopy such that upon winding the tension member onto the spool, the lower hub is raised into a position close to the upper hub.

4. The umbrella assembly of claim 1, further comprising a runner and wherein the housing is pivotally coupled to the runner.

5. The umbrella assembly of claim 4, further comprising a brake configured to secure the runner to a position along its length of travel on the support pole.

6. The umbrella assembly of claim 4, further a plurality of rollers disposed between the runner and the support pole to reduce the force required to raise and/or lower the runner.

7. An umbrella assembly comprising:

a support pole having a lower end and an upper end;

a canopy assembly comprising an upper hub having a plurality of canopy fabric support ribs and a boom extending radially therefrom, the boom being disposed between two adjacent canopy fabric support ribs and having a first end coupled with the hub and a second end disposed adjacent to the support pole;

a strut pivotally coupled with the support pole at an upper end and with the boom at a lower end;

a canopy adjustment module disposed between the boom and the support pole, the canopy adjustment module comprising:

a housing;

a shade angle mechanism disposed at least partially within the housing and configured to rotate the boom about an axis thereof to displace an opening of the canopy from horizontal by an angle; and an opening and closing mechanism at least partially disposed within the housing and operable by a crank;

wherein the canopy adjustment module further comprises a tilt angle indicator.

8. The umbrella assembly of claim 7, wherein the tilt angle indicator comprises a pointer mounted on the boom.

9. The umbrella assembly of claim 8, wherein the pointer is disposed adjacent to the housing and further comprising visual indicia on the housing adjacent to the pointer.

10. The umbrella assembly of claim 1, wherein the housing comprises canopy control indicia indicating a plurality of forms of adjustment.

11. The umbrella assembly of claim 1, wherein the housing is coupled with the support pole in a manner permitting the canopy adjustment module to be raised and lowered along the support pole.

12. The umbrella assembly of claim 1, wherein the shade angle and opening and closing mechanisms are configured to be operated by the same crank.

13. A cantilever umbrella comprising:

a support pole having a lower end and an upper end;

a boom coupled with the support pole at an inner end and having an outer end disposed away from the support pole;

a canopy assembly coupled with the boom;

a runner slideable along the support pole; and a housing disposed at the inner end of the boom and coupled with the runner at a connection location, the housing having a worm gear pair disposed therein for adjusting the shade angle of the canopy and a spool and tension member disposed therein for opening and closing the canopy, the axis of the spool being offset toward the canopy assembly from the connection location.

14. The cantilever umbrella of claim 13, further comprising a strut having an upper end pivotally coupled with an upper end of the support pole and a lower end pivotally coupled with the boom.

15. The cantilever umbrella of claim 14, further comprising a sleeve bearing coupled with the lower end of the strut, the sleeve bearing permitting rotation of the boom about an axis of the boom.

16. The cantilever umbrella of any of claim 13, wherein the boom is coupled with the support pole for inward and outward movement of the outer end and upward and downward movement of the inner end.

17. The cantilever umbrella of claim 16, wherein the runner is pivotally coupled with the housing and configured to travel upward and downward on the support pole.

18. The cantilever umbrella of claim 16, further comprising a brake disposed between the runner and the support pole for selectively fixing the runner to the support pole.

19. The cantilever umbrella of any of claim 16, further comprising a plurality of rollers disposed between the support pole and the housing.

20. An umbrella comprising:

a support structure comprising:

a first support member having an upper end;

a second support member having a first end disposed adjacent to the first support member and a second end disposed away from the first end, the second support member extending along a longitudinal axis disposed transverse to the first support member;

a canopy comprising an upper hub pivotally coupled with the second support member;

a runner slideable along the first support member; and an enclosure disposed at the first end of the second support member, coupled with the runner, and having disposed therein a tilt mechanism configured to rotate the second support pole about an axis thereof and a canopy deployment mechanism to open and close the canopy, the canopy deployment mechanism including a tension member having an end that is wound about an axis that is off-set from the runner.

21. The umbrella of claim 20, wherein the enclosure further comprises a first end connected to a runner at a pivot and a unitary side portion extending away from the first end to a second end, the second end of the enclosure being disposed between the tilt mechanism and the second end of the second support structure.

* * * * *